United States Patent [19]

Chaun-Tien

[11] Patent Number: 4,834,373

[45] Date of Patent: May 30, 1989

[54] FISHING TOY

[76] Inventor: Chuang Chaun-Tien, Tainan, Taiwan

[21] Appl. No.: 155,089

[22] Filed: Feb. 11, 1988

[30] Foreign Application Priority Data

Aug. 22, 1988 [TW] Taiwan ..... 76208182

[51] Int. Cl.[4] ..... A63F 9/00

[52] U.S. Cl. ..... 273/1 GG

[58] Field of Search ..... 273/1 GG, 1 GD, 1 GC, 273/140

[56] References Cited

U.S. PATENT DOCUMENTS 3,249,357 5/1966 Luchsinger ..... 273/1 GD
3,853,321 12/1974 Claffie ..... 273/1 GD X
4,214,750 7/1980 Shimizu ..... 273/1 GD

FOREIGN PATENT DOCUMENTS 1186225 10/1985 U.S.S.R. ..... 273/1 GG
2063079 6/1981 United Kingdom ..... 273/1 GG

*Primary Examiner*—Paul E. Shapiro
*Attorney, Agent, or Firm*—Varndell Legal Group

[57] ABSTRACT

A fishing toy includes a base rotatably mounting thereon cylinders, each having vertical holes receiving therein respective toy fishes, a smaller revolving disk rotatably mounted above the base and mounting thereon cylinders similar to those of the base, and a revolving rod rotatably mounted above the revolving disk and having a revolving speed different from that of the revolving disk so that to fish on the base and/or the revolving disk is made difficult.

2 Claims, 3 Drawing Sheets

FISHING TOY

BACKGROUND OF THE INVENTION

The present invention relates to a toy, and more particularly to a fishing toy.

In the present market, one can find a fishing toy which includes a base rotatably mounting thereon a plurality of cylinders each of which includes a plurality of vertical holes each of which receives therein a toy fish which can rise and dive and/or close and open its mouth attaching thereto a magnet. Upon playing, the player tries to fish the toy fishes by a fishing rod fixing thereto a fishing thread fastening thereto a magnet capable of attracting the magnet in the toy fish. Only when the toy fish rises and opens its mouth and the two respective magnets of the toy fish and the fishing rod are suitably matched, can the player successfully fish the toy fish. One skilled in such playing, however, will fell such known fishing toy dull.

It is therefore tried by the Applicant to make the fishing on a fishing toy difficult.

SUMMARY OF THE INVENTION

It is therefore an object of the present invention to provide a fishing toy requiring a better fishing skill.

According to the present invention, a fishing toy includes a base rotatably mounting thereon cylinders having vertical holes receiving therein toy fishes, a revolving disk rotatably mounted above the base and rotatably mounting thereon similar cylinders, and a revolving rod rotatably mounted above the revolving disk and having a revolving speed different from that of the revolving disk.

The present invention may best be understood through the following description with references to the accompanying drawings, in which:

DETAILED DESCRIPTION OF THE PREFERRED EMBODIMENT

Figure 1:
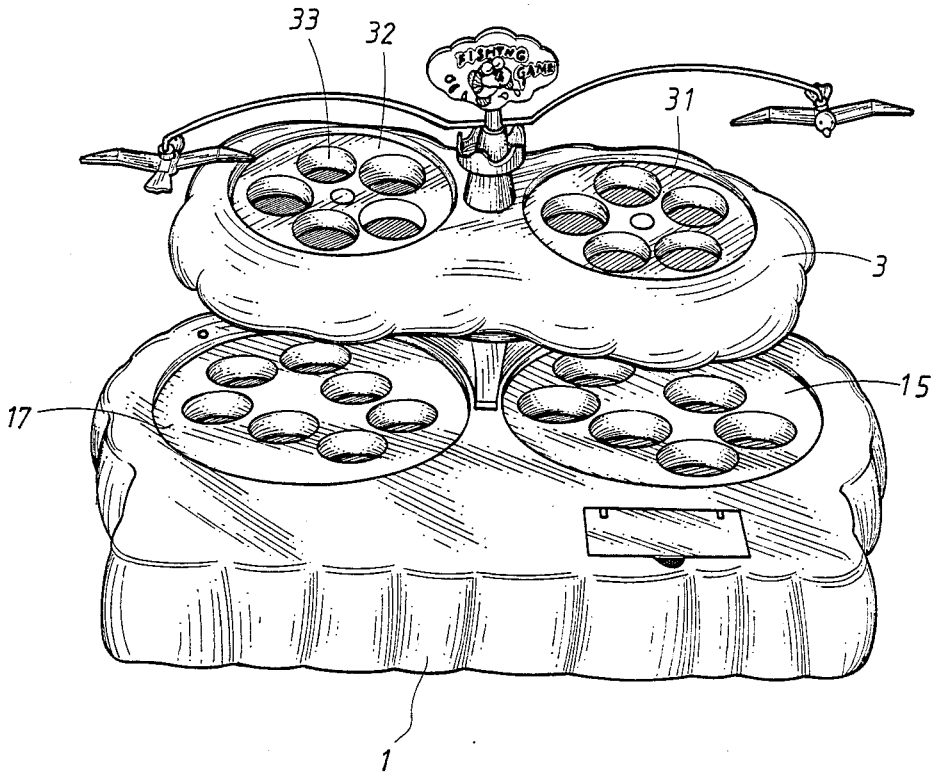
FIG. 1 is a perspective view showing a preferred embodiment of a fishing toy according to the present invention.
Figure 2:
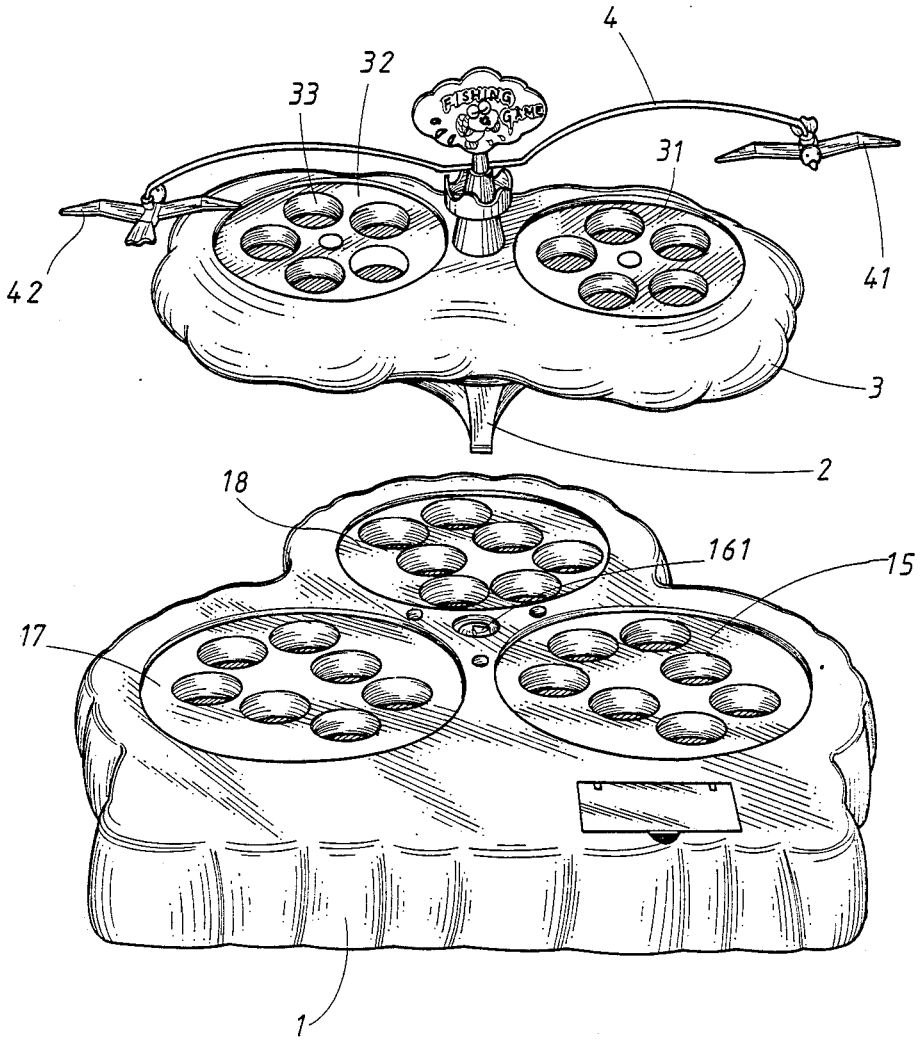
FIG. 2 is an exploded view showing a fishing toy in FIG. 1.
Figure 3:
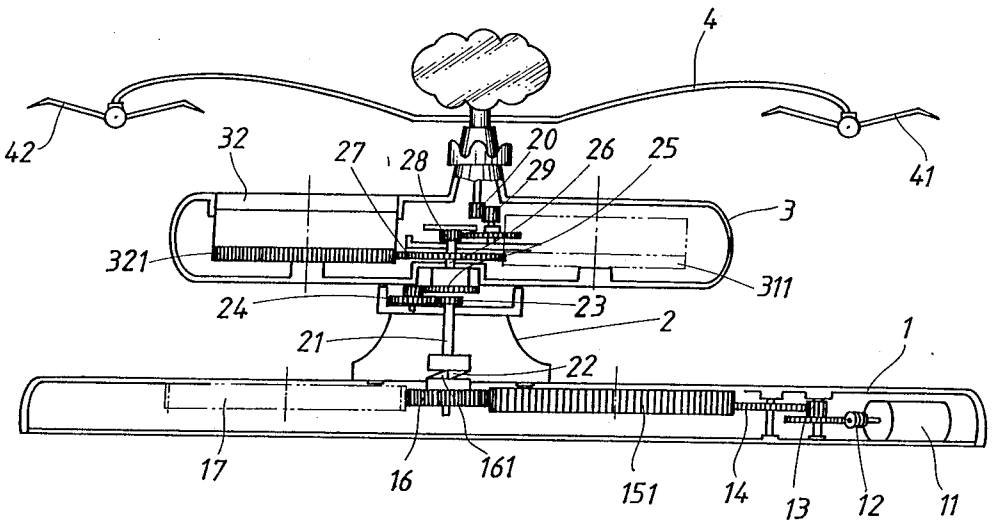
FIG. 3 is a sectional view showing a fishing toy in FIG. 1.

Referring now to FIGS. 1–3, a fishing toy according to the present invention includes a base 1, a mounting 2, a revolving disk 3 and a revolving rod 4. Base 1 rotatably mounts thereon 3 cylinders 15, 17 & 18 and includes a motor 11 having a geared spindle 12 driving a gear 151 connected to the bottom of cylinder 15 through a gear assembly 13 and an idler gear 14, and a central gear 16 simultaneously meshing with the respective gears (151) connected to the bottoms of cylinders 15, 17 & 18 and having an engaging piece 161. Cylinders 15, 17 & 18, as the conventional ones, have vertical holes receiving therein respective toy fishes.

Mounting 2 is positioned on base 1 and includes a transmission shaft 21 having an engaging piece 22 engaging with engaging piece 161 that a gear 23 on shaft 21 will drive a spindle 26 protruding into and jointing with disk 3 through a gear assembly 24 and a gear 25.

Revolving disk 3 is rotatably mounted on mounting 2, rotatably mounts thereon similar cylinders 31, 32 having vertical holes 33 and can be esthetically shaped to be smaller than base 1 in area. Spindle 26 drives a gear 27 which simultaneously meshes with and thus in turn drives gears 311, 321 respectively connected to the bottom of cylinders 31, 32.

Revolving rod 4 is rotatably mounted on disk 3, has a revolving speed different from that of disk 3, includes at its two ends two birds 41, 42, and is driven to revolve by a gear 28 on spindle 26 through a gear assembly 29 and a gear 20.

When motor 11 is energized, it will rotate cylinders 15, 17, 18, 31 & 32, disk 3 and rod 4 as well as its birds 41, 42 and will have respective toy fishes in vertical holes (33) rise and dive and/or close and open their mouths. If one wants to fish fishes in base 1, he must avoid the interference of the revolving disk 3 and rod 4. If fishes in disk 3 are to be fishes, one must free his fishing rod from being interfered by revolving rod 4.

Through the foregoing description, it can now be realized how and why the present invention can achieve its object.

What I claim is:

1. A fishing toy comprising:

a base rotatably mounting thereon a plurality of cylinders each includes a plurality of vertical holes each of which receives therein toy fish;

a revolving disk rotatably mounted above said base, rotatably mounting thereon a plurality of cylinders similar to those of said base, and smaller than said base in area; and a revolving rod rotatably mounted above said revolving disk and having a revolving speed different from that of said revolving disk so that fishing on said base and said revolving disk is made difficult.

2. A fishing toy as claimed in claim 1 wherein the bottom of each said cylinder is connected to a gear and said base mounts therein a central gear simultaneously meshing with said gears of said cylinders on said base, and the revolution of said revolving disk and bar is actuated by said central gear through respective gear trains.

* * * * *